US005908015A

United States Patent [19]

Kreuter

[11] Patent Number: 5,908,015

[45] Date of Patent: Jun. 1, 1999

[54] ARRANGEMENT FOR INTERRUPTING THE FLOW OF FORCE BETWEEN A CAMSHAFT AND A VALVE

[75] Inventor: Peter Kreuter, Aachen, Germany

[73] Assignee: Meta Motoren- und Energie Technik GmbH, Herzogenrath, Germany

[21] Appl. No.: 08/887,562

[22] Filed: Jul. 3, 1997

[30] Foreign Application Priority Data

Jul. 6, 1996 [DE] Germany ..... 196 27 390
Jul. 26, 1996 [DE] Germany ..... 196 30 309

[51] Int. Cl.[6] ..... F01L 13/00; F02D 13/02

[52] U.S. Cl. ..... 123/90.16; 123/90.4; 123/90.46; 123/198 F

[58] Field of Search ..... 123/90.15, 90.16, 123/90.17, 90.39, 90.4, 90.44, 90.46, 198 F

[56] References Cited

U.S. PATENT DOCUMENTS

| | | | |
|---|---|---|---|
| 4,607,600 | 8/1986 | Yoshizaki | 123/90.16 |
| 4,768,467 | 9/1988 | Yamada et al. | 123/90.16 |
| 4,768,475 | 9/1988 | Ikemura | 123/90.16 |
| 5,495,831 | 3/1996 | Paul et al. | 123/90.16 |
| 5,513,602 | 5/1996 | Hannibal | 123/90.16 |
| 5,544,628 | 8/1996 | Voigt | 123/90.16 |
| 5,660,153 | 8/1997 | Hampton et al. | 123/90.16 |
| 5,669,342 | 9/1997 | Speil | 123/90.16 |
| 5,680,835 | 10/1997 | Ruffing et al. | 123/90.16 |

FOREIGN PATENT DOCUMENTS

| | | |
|---|---|---|
| 4235626 | 4/1994 | Germany . |
| 55-12206 | 1/1980 | Japan . |
| 61-201807 | 9/1986 | Japan . |
| 95/02116 | 1/1995 | WIPO . |

*Primary Examiner*—Wellun Lo
*Attorney, Agent, or Firm*—Robert W. Becker & Associates

[57] ABSTRACT

An arrangement for interrupting the flow of force between a camshaft and a valve in the valve gear of an internal combustion piston engine comprises a camshaft with a cam, a rocking lever which is mounted fixedly with respect to the engine casing and the rocking movement of which is actuated by the cam and an actuating member mounted on the rocking lever and guided on the rocking lever movably relative thereto, for actuation of the valve. A movable coupling member is mounted on the rocking lever and is movable by means of an actuating device into a first position in which for actuation of the valve it provides a rigid connection between the rocking lever and the actuating member and into a second position in which the actuating member is movable relative to the rocking lever so that actuation of the valve is interrupted.

15 Claims, 7 Drawing Sheets

ARRANGEMENT FOR INTERRUPTING THE FLOW OF FORCE BETWEEN A CAMSHAFT AND A VALVE

FIELD OF THE INVENTION

The invention concerns an arrangement for interrupting the flow of force between a camshaft and a valve.

BACKGROUND OF THE INVENTION

A possible way of reducing the level of fuel consumption of internal combustion piston engines used in particular in private motor vehicles involves temporarily taking individual cylinders out of operation so that the remaining cylinders operate in the part-load range under an increased mean pressure and thus involve a lower level of specific consumption. For taking the cylinders out of operation, it is not only necessary to interrupt the feed of fuel thereto, but desirably the charge flow through the corresponding cylinders is also interrupted. To achieve that it is advantageous to stop operation of at least the inlet valves of the corresponding cylinders.

An arrangement for interrupting the flow of force from a camshaft to a valve is described in WO 95/02116. That arrangement has a rocking lever which is overall of a two-part structure, wherein its first part is actuated by the camshaft or camshafts and the second part which is mounted coaxially with the first part and which serves to actuate the valve can be coupled to the first part by way of a pin which is linearly slidably guided in the first part and which can be brought into engagement with or brought out of engagement with the second part of the rocking lever, by means of an actuating device which for example operates hydraulically. That thus provides for selective interruption of activation of the valve. A particularity of that arrangement is that, because of the coaxial mounting of the two-part actuating member, the arrangement is comparatively bulky.

SUMMARY OF THE INVENTION

The object of the present invention is to provide an arrangement for interrupting the flow of force between a camshaft and a valve, for example in the valve gear of an internal combustion piston engine, which is of a compact construction while affording a high level of operational reliability and simplicity of structure.

A further object of the present invention is to provide an arrangement for selectively and controlledly interrupting the actuation of a valve in an internal combustion piston engine, which affords precise and efficient control of selective interruption of valve actuation.

In accordance with the invention the foregoing and other objects are attained by an arrangement for interrupting the flow of force between a camshaft and a valve, for example in the valve gear of an internal combustion piston engine, comprising a camshaft having a cam, and a rocking lever mounted pivotably about an axis fixed relative to the engine and movable by the cam. An actuating member is carried by the rocking lever and is guided thereon movably relative thereto. A movable coupling member is mounted in the rocking lever movably by an actuating device between a first position of providing a rigid connection between the rocking lever and the actuating member and a second position in which the actuating member is movable relative to the rocking lever so that actuation of the valve is interrupted.

Because the actuating member is mounted directly to the rocking lever and is guided thereon movably relative to the rocking lever, the invention permits the arrangement to be of an extremely compact structure, and the arrangement takes up only immaterially more space than a conventional valve gear which includes a rocking lever (pull lever or rocker arm).

In a preferred arrangement the actuating member is guided for linear movement in the rocking lever and has an opening in its peripheral surface and the coupling member is a coupling shaft which is mounted rotatably in the rocking lever and which in the region of its engagement with the actuating element has a cross-section such that in the first position it engages into the opening provided in the peripheral surface of the actuating member and in the second position it is free from said engagement. That provides a simple mechanism involving low pressures in relation to surface area and thus a high level of durability.

A preferred form of that arrangement provides that the coupling shaft has a part-cylindrical peripheral surface with an end region towards said valve and in the first position said end region of the part-cylindrical peripheral surface bears against a corresponding surface of said opening. This can ensure surface contact between the coupling shaft and the actuating member.

In a further preferred embodiment the arrangement includes means for constantly urging the rocking lever into contact against the cam, and also a biasing means for constantly urging the coupling member into its first position, wherein the actuating device upon actuation thereof urges the coupling member into the second position, overcoming the force of the biasing means. That has the further advantage that coupling or decoupling as between the actuating member and the rocking lever occurs outside the rest or closed position of the valve, which involves a particularly high level of operational reliability. The design configuration is further such that, in the event of failure of the actuating device for the coupling member, actuation of the valve is reliably ensured, by way of the camshaft.

The actuating member may be a hydraulic valve clearance compensating element which in the closed condition of the valve is supported between the valve and a cylindrical base circle of the camshaft. In that way a valve clearance compensating element is integrated into the arrangement, without requiring additional space.

A further preferred arrangement according to the invention is one in which the coupling member is a coupling shaft mounted substantially parallel to the camshaft and to the pivot axis of the rocking lever, and including mounted on the coupling shaft at least one roller which follows the cam, giving a particularly compact embodiment of the arrangement according to the invention.

In an arrangement which provides well-defined rotatability of the coupling shaft, the arrangement includes a bush or bushing arranged in the rocking lever substantially parallel to the camshaft and to the pivot axis of the rocking lever for mounting the coupling shaft forming the coupling member and at least one roller carried by the bush or bushing and co-operating with the cam.

In an embodiment of the apparatus according to the invention which is suitable in particular for cylinders with more than two charge change valves, the rocking lever includes a plurality of actuating members which are guided in the rocking lever and which are each associated with a respective valve, a common coupling shaft being provided for coupling of the actuating members to the rocking lever. That arrangement may include a plurality of rollers co-operable with respectively associated cams of the camshaft.

In a preferred feature of the invention in the region of its mounting in fixed relationship with respect to the engine casing the rocking lever has a longitudinal slot extending along its longitudinal axis, while in another preferred arrangement the rocking lever includes a mounting region which forms the mounting for the rocking lever in fixed relationship with the engine casing, an actuating region which includes at least two rollers, the coupling shaft and at least two actuating members, and arm means connecting the mounting region and the actuating region, the cross-section of the arm means being such that the arm means have a low moment of inertia perpendicularly to the mounting axis. These features provide that, when there are a plurality of rollers disposed on the rocking lever for following respectively associated cams, tolerances are compensated and the arrangement according to the invention operates in a well-defined manner.

Further objects, features and advantages of the invention will be described with reference to preferred embodiments.

DESCRIPTION OF PREFERRED EMBODIMENTS

Figure 1:
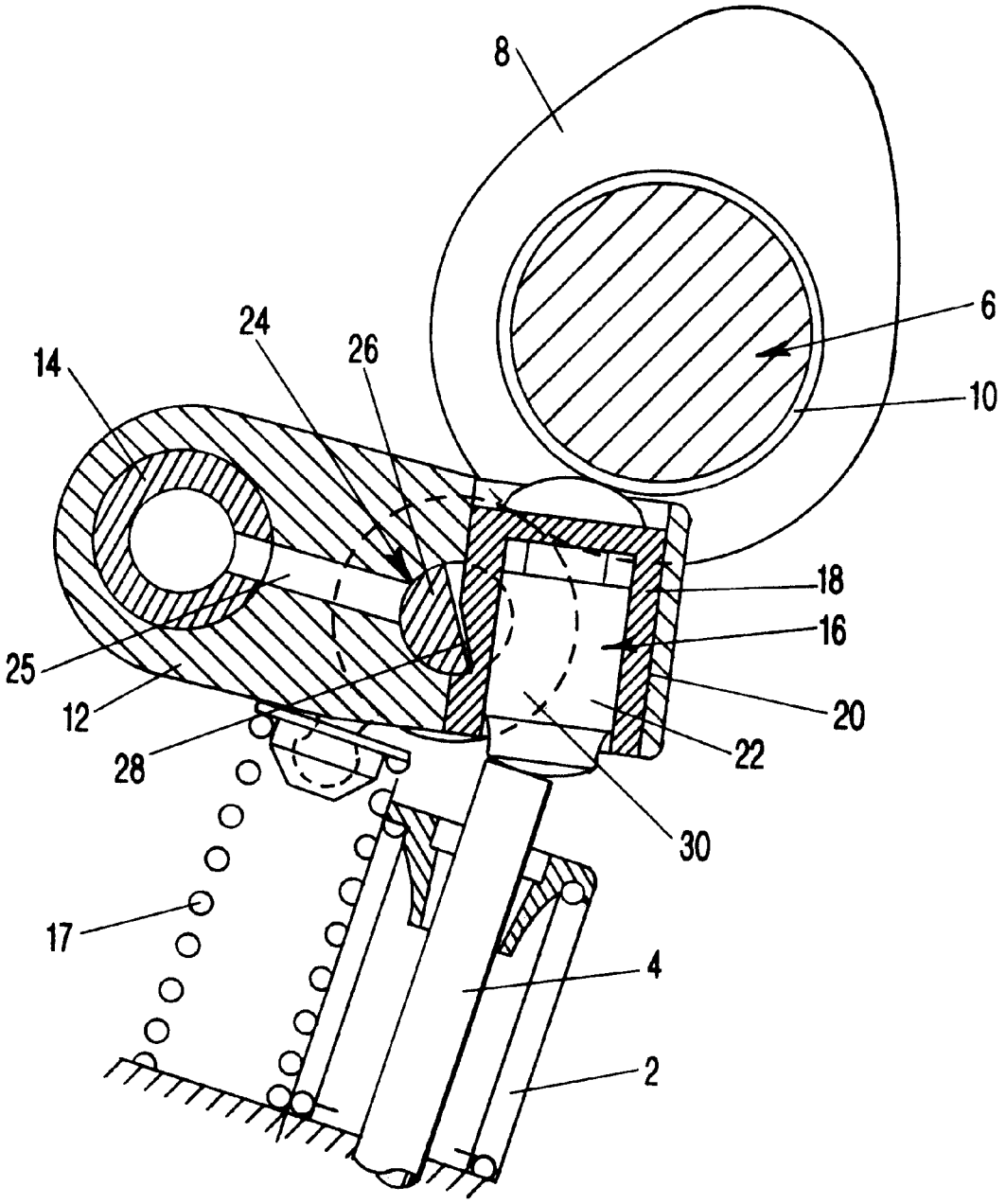
FIG. 1 is a sectional view of an arrangement according to the invention, in section through an actuating member.

Referring to FIG. 1 the arrangement according to the invention includes a valve 4 which is provided with a return spring 2 and the valve stem of which is visible in the drawing, a camshaft 6 which has at least one cam 8 and at least one cylindrical base circle portion 10, and a rocking lever 12 which is mounted pivotably about a pivot axis which is fixed with respect to the engine casing on a shaft 14. Accommodated in the end region of the rocking lever 12, which is remote from the shaft 14, is an actuating member in the form of a valve clearance compensating member or element 16 which is known per se in terms of its design configuration and structure and which for example operates hydraulically.

The rocking lever 12 is biased in the counter-clockwise direction for a rocking movement as shown in FIG. 1, by a return spring 17.

The valve clearance compensating element 16 is composed of a sleeve 18 accommodated in a through bore 20 in the rocking lever 12, and a thrust member or tappet 22. The thrust member 22 bears with its spherical end surface against the stem of the valve 4.

Mounted in the rocking lever 12 substantially parallel to the axis of the shaft 14 is a coupling member in the form of a coupling shaft 24 which can be reciprocated with a rotary movement through an angular range by means of an actuating device that is to be described hereinafter, and which provides for coupling or decoupling as between the sleeve 18 and the rocking lever 12. An oil supply passage 25 is provided for the coupling shaft 24. In the region of the sleeve 18, the coupling shaft 24 is not of a fully circular-cylindrical cross-section but has a part-circular-cylindrical cross-section as indicated at 26, in the illustrated example being of an approximately semicircular cross-section. Provided in the outside surface of the sleeve 18, corresponding to the part-circular-cylinder cross-section of the coupling shaft 24, is a notch-like opening 28 whose cross-section approximately corresponds to the cross-section, extending thereinto, of the coupling shaft 24.

In the position illustrated there is a positively locking and rigid engagement between the coupling shaft 24 and the sleeve 18 and thus a force-locking connection between the rocking lever 12 and the valve 4, which connection opens the valve 4 upon pivotal movement of the rocking lever in the clockwise direction.

That coupling condition as between the sleeve 18 and the rocking lever 12 can be released by the coupling shaft 24 being rotated out of the illustrated position in the clockwise direction in such a way that its cross-section 26 comes free from the opening 28.

A roller 30 which is mounted on the coupling shaft 24 is provided for actuation of the rocking lever 12 by means of the cam 8.

Figure 2:
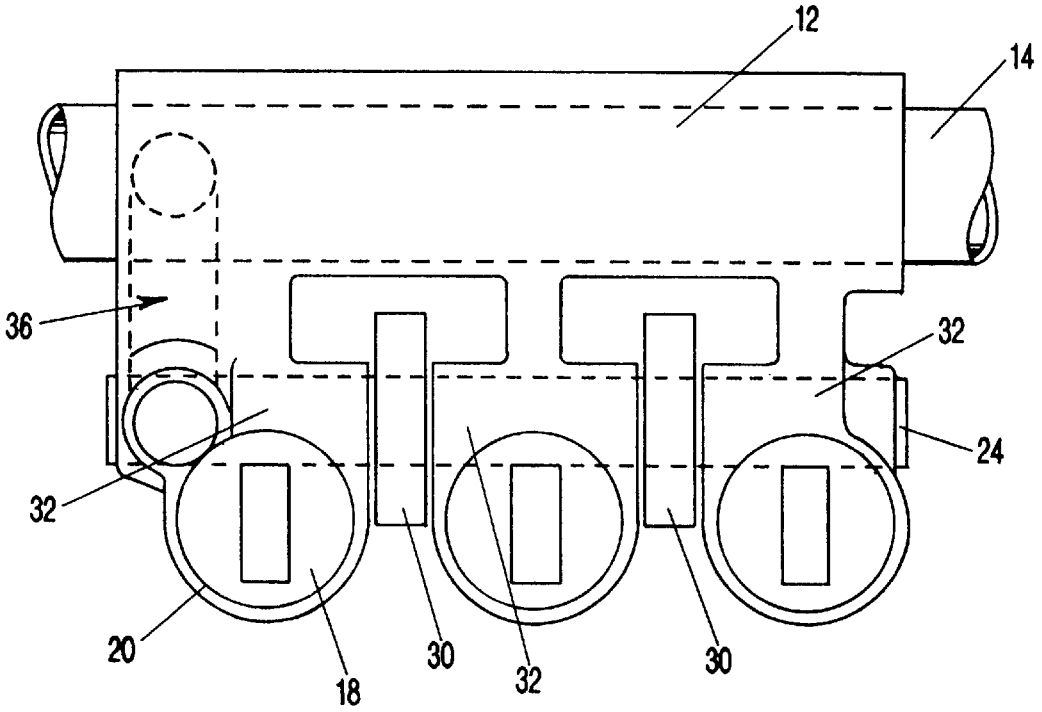
FIG. 2 is a plan view of the rocking lever of the arrangement shown in FIG. 1.

Reference will now be made to FIG. 2 showing a plan view of the rocking lever 12 shown in FIG. 1.

The rocking lever 12 which is mounted on the shaft 14 has three arms 32 with bores 20 in which the sleeves 18 of the valve clearance compensating elements 16 are guided. The spherical end surfaces with which the sleeves 18 bear in given phases of operation against the corresponding cylindrical base circle portions 10 (FIG. 1) or base circle surfaces of the camshaft are shown in the form of rectangles in the view in FIG. 2. Those spherical end surfaces could also be of a circularly symmetrical configuration if the opening as indicated at 28 in FIG. 1 extends around the entire periphery of the respective sleeve 18 and the sleeve 18 can therefore rotate within the respective bore 20.

Extending through all three arms 32 is the coupling shaft 24 so that the three sleeves 18 can be simultaneously coupled to or uncoupled from the rocking lever 12. Left free between the arms 32 are openings in which are arranged the rollers 30 which are mounted on the coupling shaft 24 and which, for actuation of the rocking lever 12, co-operate with cams 8 associated therewith on the camshaft 6. For actuation of the coupling shaft 24, an actuating device 36 is integrated into the end region of the actuating rocking lever 12, being the end region which is at the left in FIG. 2. The structure of the actuating device 36 will be described hereinafter with reference to FIG. 3.

The coupling shaft 24 is non-rotatably connected to a lever 40 which projects with a pin 42 into a bore 44 provided in the rocking lever 12. The pin 42 is held in the bore 44 between two piston or plunger components 46 and 48 which are urged towards each other by springs 50 and 52 into a central rest position in which the rotational position of the coupling shaft 24 is such that the structure is in the engagement condition shown in FIG. 1. For rotation of the coupling shaft 24 into the disengagement condition, the space or chamber beneath the piston or plunger component 48 can be supplied with hydraulic pressure so that the force of the spring 50 is overcome and the coupling shaft 24 is moved in the clockwise direction into the disengagement condition. In the hydraulic pressure-less state, the coupling shaft 24 is automatically urged back into its engagement condition.

Figure 3:
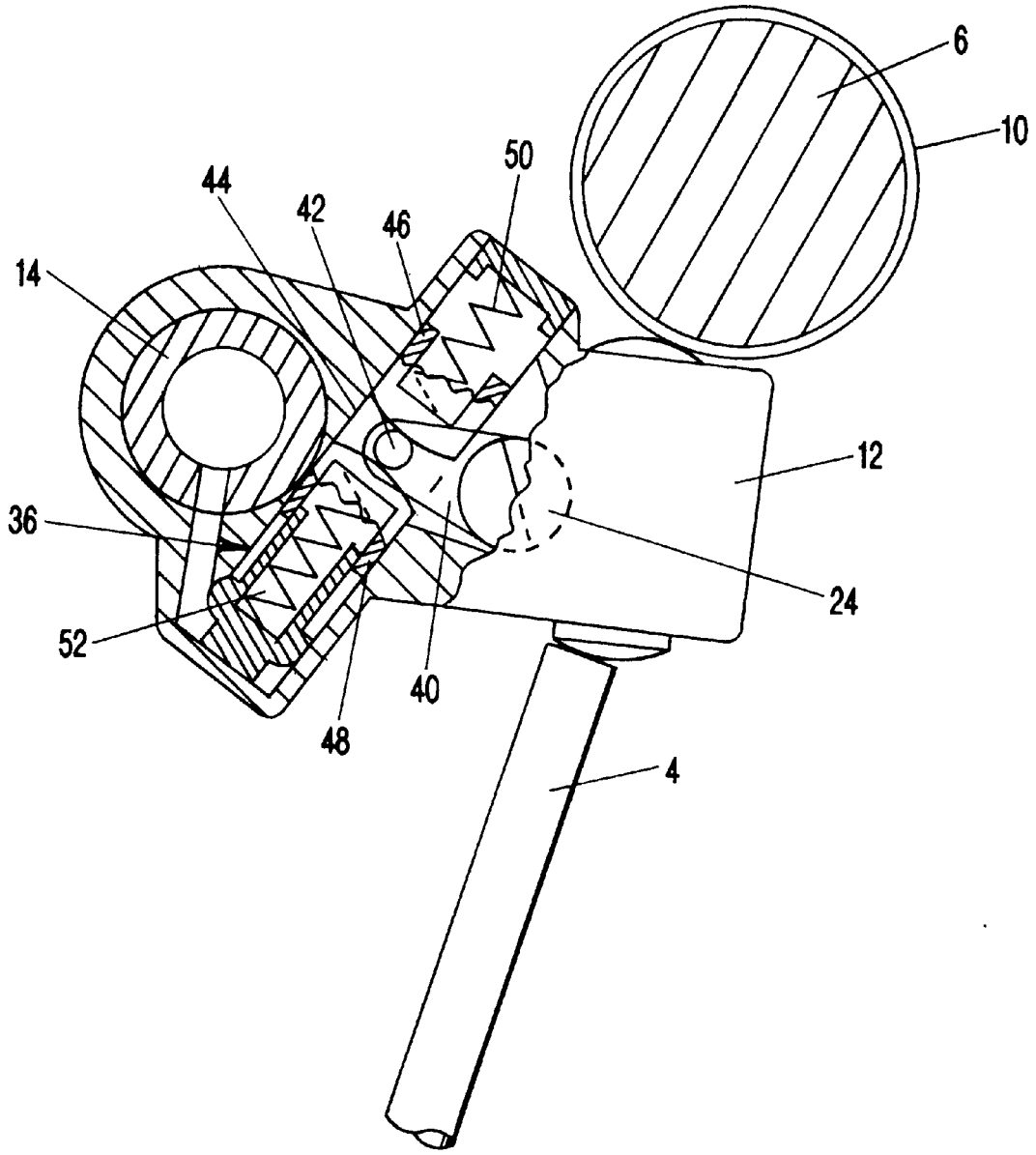
FIG. 3 is a sectional view of the arrangement shown in FIG. 1, in section through an actuating device.

Referring now also to FIG. 3, the mode of operation of the described arrangement is as follows:

In the closed condition of the valve 4 the roller 30 bears against the base circle portion 10 of the cam 8 and any valve clearance is compensated by virtue of the fact that the spherical end surface of the thrust member 22 bears against the end of the stem of the valve 4, in which case the coupling shaft 24 is for example in its engagement condition. When the camshaft 6 rotates, the rocking lever 12 is pivoted by way of the engagement between the roller 30 and the cam 8, in which case the valve 4 is actuated in accordance with the position of the camshaft 6, by virtue of the positively locking engagement between the coupling shaft 24 and the sleeve 18.

If the valve 4 is to be stopped, the coupling shaft 24 is biased in the direction of rotation in the clockwise direction by applying a hydraulic pressure to the piston or plunger component 48. As soon as the frictional moment between the coupling shaft 24 and the opening 28 is sufficiently low, that in to say for example just before complete closure of the valve 4, the coupling shaft 24 rotates out of the opening 28 so that the engagement between the sleeve 18 and the rocking lever 12 is released and the valve clearance compensating element 16 is displaceable relative to the rocking lever 12. Independently of the respective position of the rocking lever 12 the valve clearance compensating element 16 remains in contact between the valve 4 and the cylindrical base circle or base surface 10 of the camshaft 6. The valve 4 is stopped.

If the valve 4 is to be brought back into operation, the space or chamber beneath the piston or plunger component 48 is rendered pressure-less so that the coupling shaft 24 is biased into its engagement condition and rotates into that engagement condition as soon as the opening 28 as shown in FIG. 1 moves for example from below upwardly past the coupling shaft 24 and the cross-sectional portion 26 of the coupling shaft 24 passes with a snapping or latching action into the opening 28, by suitable rotary movement of the coupling shaft 24. Depending on the configuration of the cross-sectional portion 26 of the coupling shaft 24 relative to the cross-section of the opening 28, such latching or snapping engagement may already occur just before the rocking lever 12 reaches the uppermost rotational position. Linear contact with reliable compensation in respect of any tolerances can be achieved by virtue of the fact that the co-operating cross-sections are of slightly different configurations.

The above-outlined mechanism ensures an extremely high level of operational reliability with long durability. Coupling as between the rocking lever 12 and the sleeve 18 can already be attained before attainment of the rest condition (on the base circle of the cam), which is advantageous in regard to any tolerances and clearances.

It will be appreciated that numerous modifications may be made in the specific embodiment of the arrangement according to the invention, as just described above. Thus for example the valve clearance compensating element can be replaced as the actuating member for the valve by a simple thrust member or tappet or can itself be mounted pivotably on the rocking lever, in which case the rocking movement can be blocked by means of a coupling component. Actuation of the coupling component, in the illustrated embodiment being the coupling shaft, can be effected electrically, pneumatically or in some other fashion. The arrangement may have respective specific coupling shafts for the three arms of the rocking lever shown in FIG. 2 and coupling of the valve clearance compensating elements disposed therein, so that the valves can be individually taken out of operation. The cross-section of the coupling shaft which engages into the opening can be of widely differing configurations, and so forth.

Figure 4:
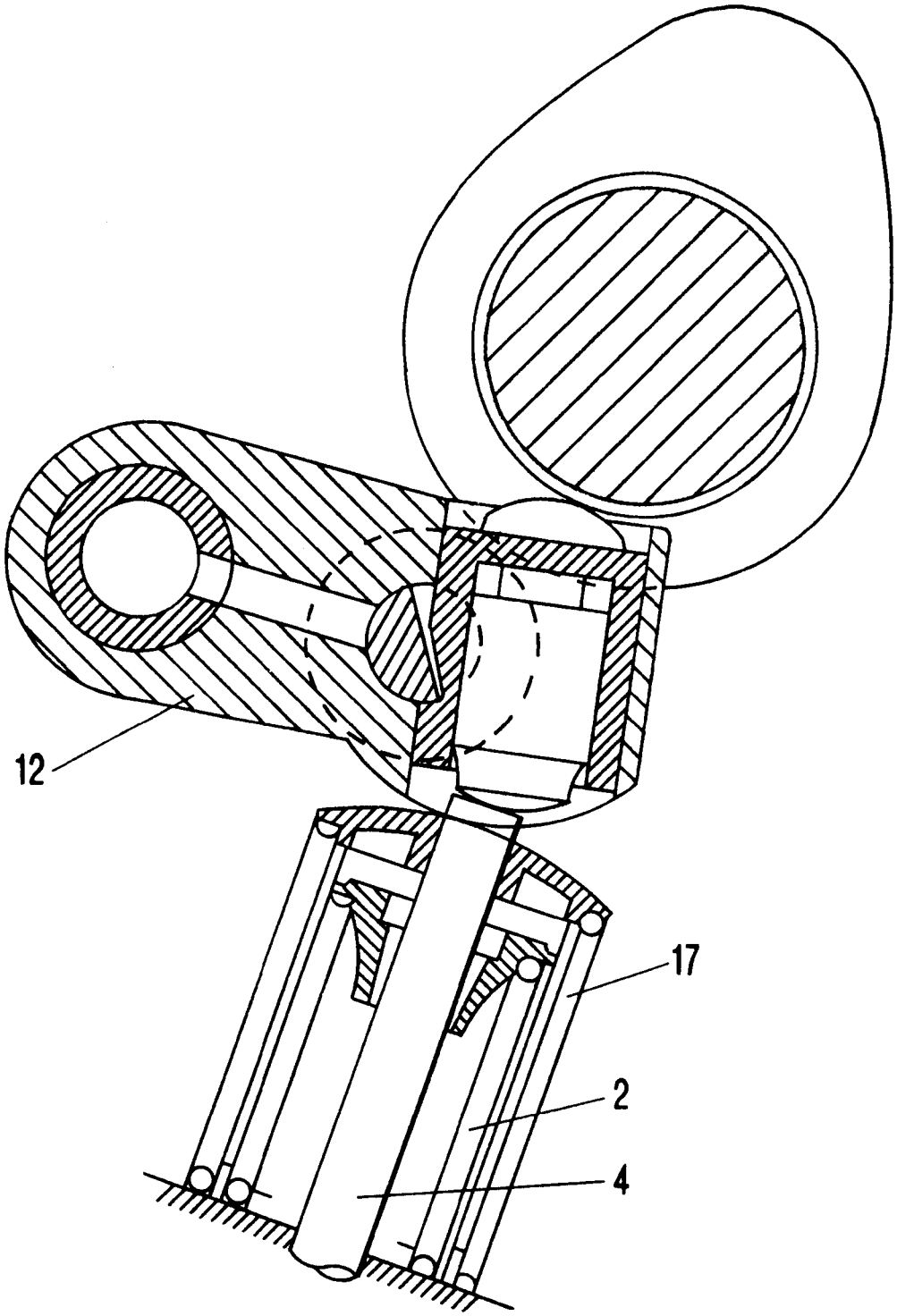
FIG. 4 is a view in cross-section through the arrangement shown in FIG. 1 with the actuating device in section.

Reference will now be made to FIG. 4 showing an embodiment of the arrangement which has been altered in relation to the configuration shown in FIG. 1 insofar as the return spring 2 for the valve 4 and the return spring 17 for the rocking lever 12 are arranged in mutually concentric relationship, which is advantageous if the arrangement does not use a multi-arm rocking lever, if for example there is only one valve. The support plate or collet of the return spring 17 bears directly against a spherical projection of suitable configuration on the rocking lever 12, through which the thrust member of the valve clearance compensating element 16 can move.

Figure 5:
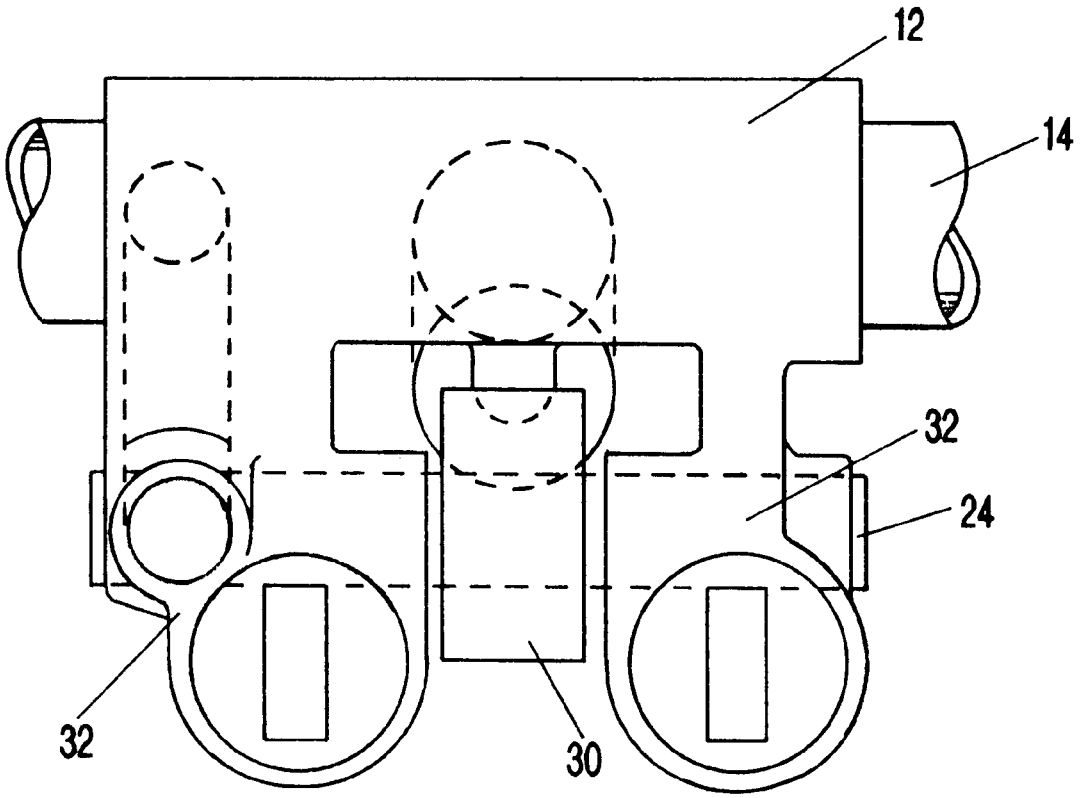
FIG. 5 is a plan view of an embodiment of a rocking lever which is modified in comparison with FIG. 1.

FIG. 5 shows an embodiment which has been modified in comparison with FIG. 2 of a rocking lever 12 having only two arms 32 and a roller 30, as is used for example for simultaneously stopping two inlet valves.

Figure 6:
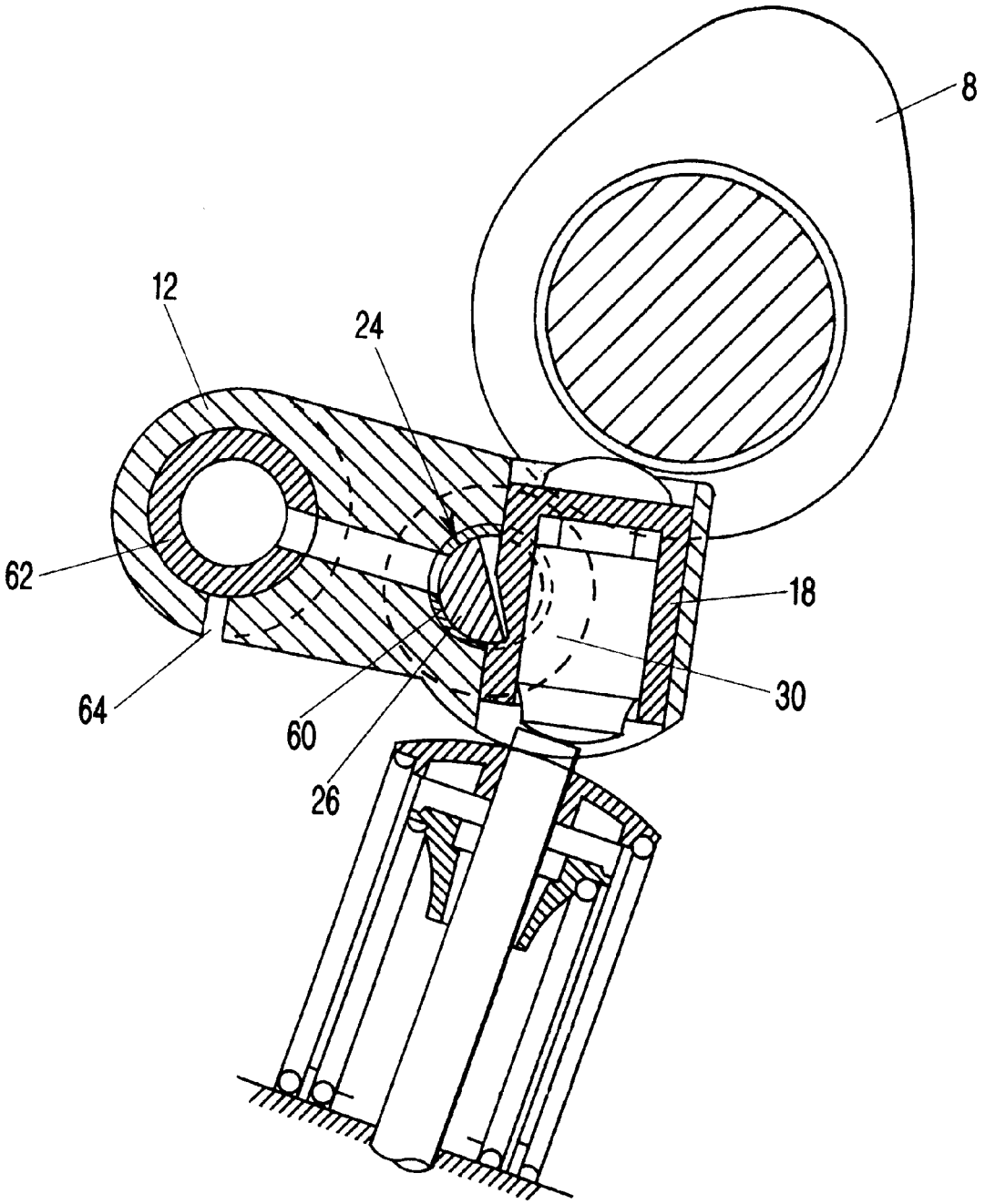
FIG. 6 is a view in section similarly to FIG. 4 of a modified embodiment.

FIG. 6 shows a construction which is modified in two respects in comparison with FIG. 4. On the one hand the coupling shaft 24 is not mounted directly in the rocking lever 12, but with the interposition of a bushing 60. The bushing 60 is recessed in the region thereof beside the sleeve 18 in such a way that the cross-sectional portion 26 of the coupling shaft 24 can engage into the sleeve 18, as described above with reference to FIG. 1.

The roller or rollers 30 (see FIG. 2) are not mounted on the coupling shaft 24 but on the bushing 60.

The bushing 60 provides that the force from the cam 8 or the roller 30 is not transmitted to the rocking lever 12 by way of the coupling shaft 24 but by way of the bushing 60 so that, for actuation thereof or for rotation thereof into a condition of engagement with the sleeve 18, the coupling shaft 24 remains free of the forces acting from the cam 8, and is thus easily rotatable.

A further alteration in the structure shown in FIG. 6 in comparison with the embodiment shown in FIG. 4 is that the rocking lever 12 is provided with a longitudinal slot 64 in the region 62 where the rocking lever 12 is mounted on the shaft 14, in fixed relationship with respect to the engine casing. The longitudinal slot 64 provides that if necessary the rocking lever 12 can twist in itself if, as shown in FIG. 2, it is designed to compensate for tolerances when the rollers 30 are actuated by cams associated therewith and in that situation different motive forces occur.

Figure 7:
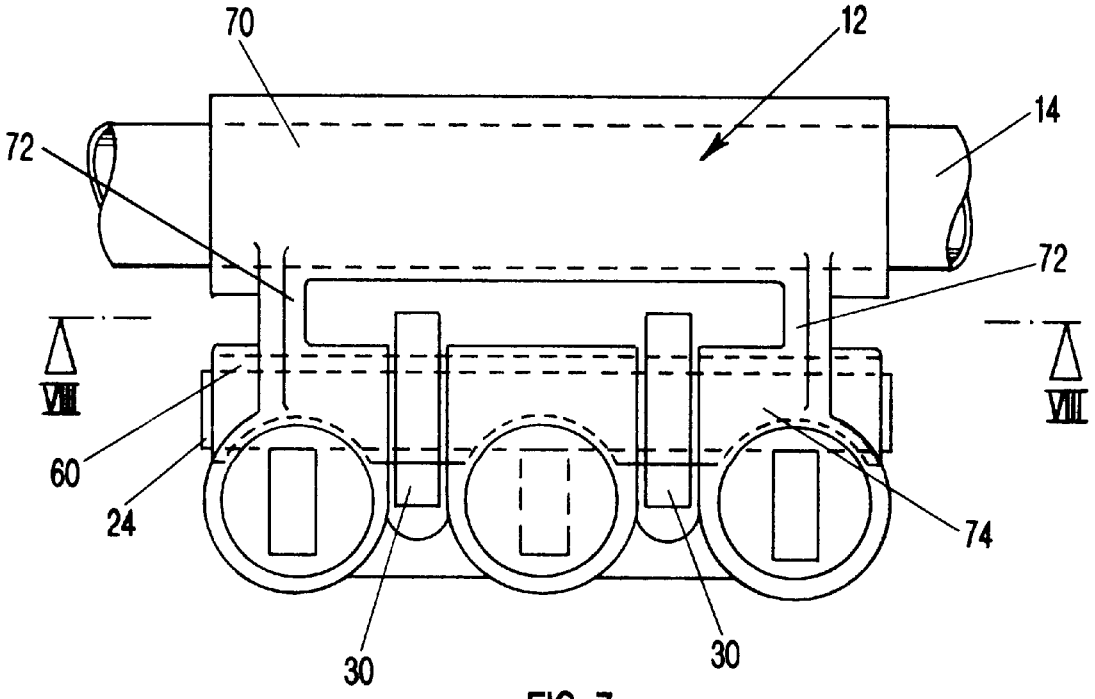
FIG. 7 is a plan view similarly to FIG. 2 of a modified embodiment.
Figure 8:
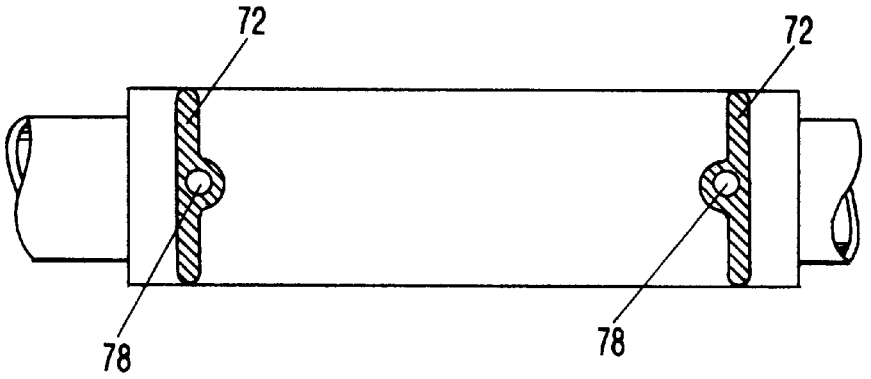
FIG. 8 is a sectional view of the embodiment of FIG. 7, in section taken along the plane VII—VII therein.

FIGS. 7 and 8 show an embodiment of the rocking lever which is modified in comparison with FIG. 2, without illustrating the actuating device for the coupling shaft 24.

A mounting region 70 of the rocking lever 12, which region is mounted on the shaft 14 or a mounting tube which is fixed with respect to the engine casing is connected by way of two arms 72 to an actuating region 74 of the rocking lever 12 which carries the bush 60 (FIG. 6), the coupling shaft 24 mounted therein and the rollers 30 mounted on the bush 60.

As can be seen from FIG. 8 the cross-section of the arms 72 which are provided with oil supply ducts 78 is generally in the shape of a plate with the width of the plate which extends parallel to the mounting axes being markedly less than the height of the plate which extends perpendicularly to the mounting axes, whereby the arms 72 can twist or flex in the form of leaf springs, but the actuating region 74 is at the same time held flexurally stiff about an axis which is parallel to the mounting axes. That cross-sectional configuration of the arms 72 is an example of the way in which a low moment of inertia for the arms is achieved, perpendicularly to the mounting axis. The actuating region 74 is additionally deformable by virtue of the incisions of openings therein which are required for the rollers 30 so that uniform and reliable co-operation between the associated cams (not shown) and the rollers 30 or reliable and well-defined actuation of the three valves (not shown) by means of deflection of the two rollers 30 is produced even if the system has tolerance therein.

The features shown in FIG. 6 relating to a torsionally soft structure for the rocking lever 12 can be used in combination with the features of FIGS. 7 and 8 or on their own.

In a further considerably simplified embodiment (not shown) of the described arrangement the coupling shaft directly forms the coupling between the rocking lever and the valve or valves insofar as, in one position thereof, it comes into engagement with the end surface of the valve stem, while in its other position it is free of such engagement. In that embodiment, the entire sleeve with the thrust member may be omitted. It will be appreciated that the rotatable coupling shaft which in this case at the same time forms the actuating member can also be replaced by a linearly movable component.

It will be appreciated that the above-described embodiments of the invention have been set forth solely by way of example and illustration of the principles of the invention and that various other modifications and alterations may be made therein without thereby departing from the scope of the invention.

What is claimed is:

1. An arrangement for interrupting the flow of force between a camshaft and a valve, said arrangement comprising:

a camshaft with a cam;

a rocking lever;

means for mounting a first end of said rocking lever so as to pivot about a pivot axis, fixed relative to the engine, upon actuation by said cam;

an actuating member supported in said rocking lever and moveably guided relative to said rocking lever, said actuating member actuating a valve;

a movable coupling member mounted on said rocking lever;

said coupling member movable into a first position, in which said coupling member provides a rigid connection between said rocking lever and said actuating member for actuating the valve, and into a second position, in which said actuating member is movable relative to said rocking lever so that actuation of the valve is interrupted;

an actuating device for moving said coupling member between said first and second position;

said actuating member linearly guided in said rocking lever and having a peripheral surface provided with an opening:

said coupling member being a coupling shaft;

said coupling shaft rotatably mounted in said rocking lever;

said coupling member having a cross-sectional portion in a region of engagement of said actuating member being rotated into said first position for engagement of said opening of said actuating member and rotated to said second position for disengagement with said opening of said actuating member.

2. An arrangement according to claim 1 wherein:

said coupling shaft has a non-circular peripheral surface having one end region facing the valve; and in said first position said end region of said part-cylindrical peripheral surface bears against a support surface of said opening.

3. An arrangement according to claim 1, including a first biasing means for constantly forcing said rocking lever into contact against said cam and a second biasing means for constantly forcing said coupling member into said first position, wherein said actuating device, when actuated, forces said coupling member into said second position by overcoming a force of said second biasing means.

4. An arrangement according to claim 1, wherein said actuating member is a hydraulic valve clearance compensating element which, in a closed position of the valve, is supported between the valve and a cylindrical base circle of said camshaft.

5. An arrangement according to claim 1, further comprising at least one roller mounted on said coupling member and following said cam, wherein said coupling member is a coupling shaft mounted substantially parallel to said camshaft and parallel to the pivot axis of said rocking lever.

6. An arrangement according to claim 5, wherein said rocking lever includes a plurality of said actuating members guided in said rocking lever and each associated with a respective valve, wherein said coupling member is a coupling shaft coupling all of said actuating members to said rocking lever.

7. An arrangement according to claim 6, including a plurality of said rollers, wherein said camshaft has a plurality of said cams, and wherein said rollers co-operate with respectively associated ones of said cams.

8. An arrangement according to claim 7, wherein said first end of said rocking lever has a longitudinal slot extending along a longitudinal axis thereof.

9. An arrangement according to claim 7, wherein said rocking lever has a second end, where at least two of said rollers, said coupling shaft and at least two of said actuating members are positioned, and arm means connecting said first end and said second end, wherein said arm means have a cross section providing a low moment of inertia perpendicular to said pivot axis.

10. An arrangement according to claim 1, including:

a bushing mounted in said rocking lever substantially parallel to said camshaft and to the pivot axis of said rocking lever, wherein said coupling member is a coupling shaft mounted in said bushing; and at least one roller supported by said bushing and co-operating with said cam.

11. An arrangement according to claim 10, wherein said rocking lever includes a plurality of said actuating members guided in said rocking lever and each associated with a respective valve, wherein said coupling member is a coupling shaft coupling all of said actuating members to said rocking lever.

12. An arrangement according to claim 11, including a plurality of said rollers, wherein said camshaft has a plurality of said cams, and wherein said rollers co-operate with respectively associated ones of said cams.

13. An arrangement according to claim 12, wherein said first end of said rocking lever has a longitudinal slot extending along a longitudinal axis thereof.

14. An arrangement according to claim 12, wherein said rocking lever has a second end, where at least two of said rollers, said coupling shaft and at least two of said actuating members are positioned, and arm means connecting said first end and said second end, wherein said arm means have a cross section providing a low moment of inertia perpendicular to said pivot axis.

15. An internal combustion engine including a valve; a camshaft with a cam for actuating the valve; and an arrangement for interrupting the flow of actuating force between the camshaft and the valve, said arrangement comprising:

a rocking lever;

means for mounting a first end of said rocking lever so as to pivot about a pivot axis, fixed relative to the engine, upon actuation by said cam;

an actuating member supported in said rocking lever and moveably guided relative to said rocking lever, said actuating member actuating a valve;

a movable coupling member mounted on said rocking lever;

said coupling member movable into a first position, in which said coupling member provides a rigid connection between said rocking lever and said actuating member for actuating the valve, and into a second position, in which said actuating member is movable relative to said rocking lever so that actuation of the valve is interrupted;

an actuating device for moving said coupling member between said first and second positions;

said actuating member linearly guided in said rocking lever and has a peripheral surface provided with an opening;

said coupling member being a coupling shaft;

said coupling shaft rotatably mounted in said rocking lever;

said coupling member having a cross-sectional portion in a region of engagement of said actuating member being rotated into said first position for engagement of said opening of said actuating member and rotated to said second position for disengagement with said opening of said actuating member.

* * * * *